US009304425B2

(12) United States Patent
Noguchi et al.

(10) Patent No.: US 9,304,425 B2
(45) Date of Patent: Apr. 5, 2016

(54) BRILLIANT TONER, ELECTROSTATIC CHARGE IMAGE DEVELOPER, AND TONER CARTRIDGE

(71) Applicant: FUJI XEROX CO., LTD., Tokyo (JP)

(72) Inventors: Daisuke Noguchi, Kanagawa (JP); Sakiko Hirai, Kanagawa (JP); Masaru Takahashi, Kanagawa (JP); Atsushi Sugitate, Kanagawa (JP); Shuji Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 30 days.

(21) Appl. No.: 14/267,179

(22) Filed: May 1, 2014

(65) Prior Publication Data

US 2015/0111140 A1 Apr. 23, 2015

(30) Foreign Application Priority Data

Oct. 17, 2013 (JP) ..... 2013-216749

(51) Int. Cl.

| | |
|---|---|
| ***G03G 9/00*** | (2006.01) |
| ***G03G 9/09*** | (2006.01) |
| ***G03G 9/08*** | (2006.01) |
| ***G03G 9/087*** | (2006.01) |

(52) U.S. Cl.

CPC ..... *G03G 9/0902* (2013.01); *G03G 9/0827* (2013.01); *G03G 9/08755* (2013.01); *G03G 9/08795* (2013.01); *G03G 9/08797* (2013.01); *G03G 9/091* (2013.01)

(58) Field of Classification Search

CPC G03G 9/0902; G03G 9/08755; G03G 9/0827
USPC ..... 430/107.1, 109.4
See application file for complete search history.

(56) References Cited

U.S. PATENT DOCUMENTS

| | | | | |
|---|---|---|---|---|
| 2002/0192585 | A1* | 12/2002 | Brenner et al. | 430/108.6 |
| 2009/0258310 | A1* | 10/2009 | Matsumoto et al. | 430/109.2 |
| 2011/0318683 | A1* | 12/2011 | Kadokura et al. | 430/105 |
| 2013/0078562 | A1 | 3/2013 | Takahashi et al. | |

FOREIGN PATENT DOCUMENTS

| | | |
|---|---|---|
| JP | A-62-100770 | 5/1987 |
| JP | A-2003-207911 | 7/2003 |
| JP | A-2012-163695 | 8/2012 |
| JP | A-2013-073017 | 4/2013 |

* cited by examiner

*Primary Examiner* — Thorl Chea
(74) *Attorney, Agent, or Firm* — Oliff PLC

(57) ABSTRACT

A brilliant toner includes toner particles containing a brilliant pigment, and toner particles containing a yellow colorant without containing the brilliant pigment, wherein a ratio of the toner particles containing the yellow colorant without containing the brilliant pigment is 50% by number or greater.

20 Claims, 3 Drawing Sheets

BRILLIANT TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-216749 filed Oct. 17, 2013.

BACKGROUND

Technical Field

The present invention relates to a brilliant toner, an electrostatic charge image developer, and a toner cartridge.

SUMMARY

According to an aspect of the invention, there is provided a brilliant toner including:

toner particles containing a brilliant pigment; and toner particles containing a yellow colorant without containing the brilliant pigment, wherein a ratio of the toner particles containing the yellow colorant without containing the brilliant pigment is 50% by number or greater.

BRIEF DESCRIPTION OF THE DRAWINGS

Exemplary embodiments of the present invention will be described in detail based on the following figures, wherein.

DETAILED DESCRIPTION

Figure 1:
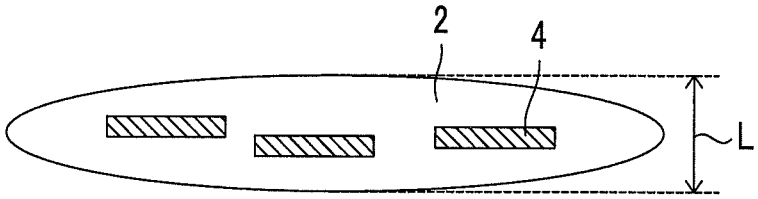
FIG. 1 is a cross-sectional view schematically showing an example of a brilliant toner particle according to an exemplary embodiment.

Hereinafter, exemplary embodiments of a brilliant toner, an electrostatic charge image developer, a toner cartridge, a process cartridge, an image forming apparatus, and an image forming method of the invention will be described in detail.

Brilliant Toner

A brilliant toner according to an exemplary embodiment (hereinafter, may be referred to as "toner") has toner particles containing a brilliant pigment (hereinafter, may be referred to as "brilliant toner particles") and toner particles containing a yellow colorant without containing the brilliant toner (hereinafter, may be referred to as "yellow toner particles"). When cross-sections of individual toner particles are observed to confirm whether the brilliant pigment is contained and whether the yellow colorant is contained in all of the toner particles, the ratio of the yellow toner particles in the toner particles not containing the brilliant pigment is 50% by number or greater.

Since the brilliant toner according to this exemplary embodiment has the above-described configuration, an image in which the generation of streaky image defects caused by the deformation of a cleaning blade is suppressed is obtained compared to a case in which the ratio of the yellow toner particles is less than 50% by number. The reasons for this are not clear, but are presumed as follows.

Since the brilliant toner particles in the brilliant toner contain flake-shape brilliant pigment particles, the brilliant toner particles are likely to have a flake shape. Therefore, when a cleaning blade is used as a cleaner of an image holding member, the brilliant toner particles are easily sandwiched between the image holding member and the cleaning blade. At this time, the cleaning blade may be deformed due to a force locally added to the cleaning blade. As a result, streak image defects may be generated.

Since the yellow toner particles contain no flake shape brilliant pigment particles, the particles have a substantially non-flake shape, that is, a spherical shape, compared to the brilliant toner, and are likely to have a small diameter.

When the yellow toner particles having a substantially spherical shape are supplied between the image holding member and the cleaning blade, it is thought that the force locally added to the cleaning blade due to the brilliant toner is lessened. In addition, since the spherical yellow toner particles have a smaller diameter than the brilliant toner particles, a charge amount per toner particle is likely to decrease. In addition to this, the yellow colorant is likely to widen the charging distribution of the yellow toner. Therefore, a phenomenon in which the toner adheres to a non-image part in a surface of the image holding member (hereinafter, may be referred to as "fogging") is likely to occur. Furthermore, when the ratio of the yellow toner particles is 50% by number or greater in all of the toner particles not containing the brilliant pigment, the yellow toner particles are easily supplied over the entire tip end part of the cleaning blade in a width direction. As a result, the deformation of the cleaning blade is easily suppressed, and thus it is thought that the generation of streak image defects is suppressed.

In addition, since the toner according to this exemplary embodiment has a yellow colorant having higher brightness than a black colorant, a blue colorant, and a red colorant, it is thought that the brilliance of the toner is difficult to decrease.

The ratio of the yellow toner particles in the toner particles not containing the brilliant pigment is preferably 70% by number or greater, and more preferably 80% by number or greater.

In this exemplary embodiment, the content of the yellow colorant is preferably from 10 parts by weight to 70 parts by weight with respect to 100 parts by weight of the brilliant pigment. The reason for this is that when the content of the yellow colorant is within the foregoing range, it is thought that toner particles not containing the brilliant pigment are supplied to the tip end part of the cleaning blade, and thus the deformation of the cleaning blade is suppressed and the brilliance of the toner is difficult to decrease due to the light absorption of the yellow colorant.

The content of the yellow colorant means the content of the yellow colorant in the entire toner. The content of the yellow colorant is more preferably from 20 parts by weight to 60 parts by weight, and even more preferably from 30 parts by weight to 50 parts by weight with respect to 100 parts by weight of the brilliant pigment.

In this exemplary embodiment, the ratio of the toner particles not containing the brilliant pigment in all of the toner particles is preferably 80% by number or less. The reason for this is that when the ratio of the toner particles not containing the brilliant pigment is 80% by number or less, the deformation of the cleaning blade due to excessive supply of the toner particles not containing the brilliant pigment is difficult to proceed.

In addition, when the ratio of the toner particles not containing the brilliant pigment is 80% by number or less, the brilliance is difficult to decrease.

The ratio of the toner particles not containing the brilliant pigment in all of the toner particles is more preferably 70% by number or less, and even more preferably 55% by number or less.

In this exemplary embodiment, as a method of observing cross-sections of individual toner particles to confirm whether the brilliant pigment is contained and whether the yellow colorant is contained in all of the toner particles, for example, the following method is exemplified.

First, toner particles are embedded using a bisphenol-A liquid epoxy resin and a curing agent, and then a sample for cutting is prepared. Next, the sample for cutting is cut at −100° C. using a cutting machine with a diamond knife, e.g., a LEICA Ultramicrotome (manufactured by Hitachi Technologies and Services, Ltd.), thereby preparing a sample for observation. The observation sample is observed using a TEM at a magnification of approximately 5,000 times.

Whether the toner particles contain a brilliant pigment is determined using, for example, the following method. Specifically, since the brilliant pigment has a composition different from that of a binder resin therearound and its shape is a characteristic flake shape, the brilliant toner is discriminated by means of tone differences in the observed image and the shape, and a part that exists in rods in a cross-section of a toner particles and has a different contrast is determined as a brilliant pigment.

In addition, whether the toner particles contain a yellow colorant is determined from tone differences in the observed image. A part that exists in circles in a cross-section of a toner particle and has a different contrast is determined as a yellow colorant.

In this manner, cross-sections of 5,000 toner particles are observed to calculate a ratio of the number of the toner particles not containing the brilliant pigment and a ratio of the yellow toner particles in the toner particles not containing the brilliant pigment.

In this exemplary embodiment, the term "brilliance" represents that glitter like a metallic luster is seen when an image formed using the brilliant toner according to this exemplary embodiment is visually recognized.

Examples of the brilliant toner include a toner in which a ratio (A/B) of a reflectance A at a light-receiving angle of +30° to a reflectance B at a light-receiving angle of −30° measured using a variable angle photometer when a solid image is formed and irradiated with incident light at an incident angle of −45° is from 2 to 100.

The fact that the ratio (A/B) is 2 or greater indicates that the amount of the light reflected to the side opposite to the side on which the incident light enters (plus-angle side) is greater than that of the light reflected to the incident side (minus-angle side). That is, the fact indicates that diffuse reflection of the incident light is suppressed. In the case in which diffuse reflection in which the incident light is reflected in various directions occurs, when the reflected light is visually recognized, colors appear to be dull. Therefore, when the ratio (A/B) is 2 or greater, a luster is confirmed when the reflected light is visually recognized, whereby excellent brilliance is obtained.

On the other hand, when the ratio (A/B) is 100 or less, an angle of view at which the reflected light may be visually recognized is not too narrow, and thus a phenomenon in which colors appear to be dark according to the angle is difficult to occur.

The ratio (A/B) is more preferably from 20 to 90, and especially preferably from 40 to 80.

Measurement of Ratio (A/B) Using Variable Angle Photometer

Here, first, an incident angle and a light-receiving angle will be described. In this exemplary embodiment, in the measurement using a variable angle photometer, the incident angle is −45°, and the reason for this is that high measurement sensitivity is achieved for images having a wide range of glossiness.

In addition, the light-receiving angle is −30° or +30°, and the reason for this is that the highest measurement sensitivity is achieved in the evaluation of brilliant images and non-brilliant images.

Next, a method of measuring the ratio (A/B) will be described.

In this exemplary embodiment, in the measurement of the ratio (A/B), first, a "solid image" is formed using the following method. A developing device of a DocuCentre-III C7600 manufactured by Fuji Xerox Co., Ltd. is filled with an electrostatic charge image developer that is a sample, and a solid image having a toner amount of 4.5 g/cm$^2$ is formed on a recording sheet (OK Top Coat+ paper, manufactured by Oji Paper Co., Ltd.) at a fixing temperature of 190° C. and a fixing pressure of 4.0 kg/cm$^2$. The "solid image" refers to an image having a coverage rate of 100%.

Incident light at an incident angle of −45° is radiated on an image part of the formed solid image by using a spectral varied angle color-difference meter GC5000L as a variable angle photometer manufactured by Nippon Denshoku Industries Co., Ltd., and a reflectance A at a light-receiving angle of +30° and a reflectance B at a light-receiving angle of −30° are measured. Each of the reflectance A and the reflectance B is measured with light having a wavelength of from 400 nm to 700 nm at intervals of 20 nm, and defined as an average of the reflectances at respective wavelengths. The ratio (A/B) is calculated from these measurement results.

The brilliant toner according to this exemplary embodiment preferably satisfies the following requirements (1) and (2) from the viewpoint of satisfying the above-described ratio (A/B).

(1) The particles of the brilliant toner have an average equivalent circle diameter D larger than an average maximum thickness C.

(2) When observing cross-sections of the particles of the brilliant toner in a thickness direction, the ratio of brilliant pigment particles that are present so that an angle between a long axis direction of the toner particles in the cross-sections and a long axis direction of the brilliant pigment particles is from −30° to +30° is 60% or greater of the total number of brilliant pigment particles that are observed.

FIG. 1 shows a cross-sectional view schematically showing an example of a toner particle satisfying the above-described requirements (1) and (2). The schematic view shown in FIG. 1 is a cross-sectional view of the toner particle in a thickness direction thereof.

A toner particle 2 shown in FIG. 1 is a flake shape toner particle having an equivalent circle diameter larger than a thickness L, and contains flake shape brilliant pigment particles 4.

In the case in which the toner particle 2 has a flake shape in which the equivalent circle diameter is larger than the thickness L as shown in FIG. 1, when the toner particle is moved to an image holding member, an intermediate transfer member, a recording medium, or the like in a developing step or a transfer step in the image formation, the toner particle tends to move so as to cancel out the charge of the toner particle to the maximum extent. Therefore, it is thought that the toner particles are arranged so that the adhering area becomes the maximum. That is, it is thought that the flake shape toner particles are arranged so that the flat surface sides thereof face a surface of a recording medium onto which the toner particles are finally transferred. In addition, in a fixing step in the image formation, it is thought that the flake shape toner particles are also arranged by the pressure during fixing so that the flat surface sides thereof face the surface of the recording medium.

Therefore, among the flake shape brilliant pigment particles contained in the toner particles, brilliant pigment particles that satisfy "an angle between a long axis direction of the toner in the cross-section and a long axis direction of the brilliant pigment particles is from −30° to +30°" described in the requirement (2) are thought to be arranged so that the surface side that provides the maximum area faces the surface of the recording medium. It is thought that, when an image formed in this manner is irradiated with light, the ratio of brilliant pigment particles that cause diffuse reflection of the incident light is suppressed, and thus the above-described range of the ratio (A/B) is achieved.

Hereinafter, the toner according to this exemplary embodiment will be described in detail.

The toner according to this exemplary embodiment is configured to contain toner particles, and if necessary, an external additive.

In addition, the toner particles include the brilliant toner particles and the yellow toner particles, and may include toner particles containing neither brilliant pigment nor yellow colorant.

Hereinafter, simple "toner particles" refer to a general term for the brilliant toner particles, the yellow toner particles, and the toner particles containing neither brilliant pigment nor yellow colorant.

Toner Particles

The toner particles are configured to contain, for example, a binder resin, and if necessary, a colorant, a release agent and other additives.

Among the toner particles contained in the brilliant toner, the brilliant toner particles contain a brilliant pigment as a colorant, and may contain a yellow colorant. If necessary, other colorant may also be contained. The yellow toner particles contain a yellow colorant as a colorant, and may also contain colorants other than the brilliant pigment, if necessary. When there are toner particles containing neither brilliant toner nor yellow colorant, colorants other than the brilliant pigment and the yellow colorant may be contained, but the colorant is preferably not contained.

Regarding components other than the colorant (that is, the binder resin, and if necessary, the release agent and other additives), different materials may be used in the respective cases of the brilliant toner particles, the yellow toner particles, and the toner particles containing neither brilliant pigment nor yellow colorant. However, the same kinds of materials are preferably used.

Brilliant Pigment

Examples of the brilliant pigment include metal powders such as an aluminum powder, a brass powder, a bronze powder, a nickel powder, a stainless-steel powder, and a zinc powder, coated flake-like inorganic crystalline materials such as mica, barium sulfate, lamellar silicate, and silicate of lamellar aluminum coated with titanium oxide or yellow iron oxide, monocrystalline plate-like titanium oxide, basic carbonate, acidic bismuth oxychloride, natural guanine, a flake-like glass powder, and a metal-deposited flake-like glass powder. The brilliant pigment is not particularly limited as long as it has brilliance.

Among the brilliant pigments, aluminum is most preferably used from the viewpoint of brilliance and environment safety.

The content of the brilliant pigment in the brilliant toner particles is preferably from 1 part by weight to 70 parts by weight, and more preferably from 5 parts by weight to 50 parts by weight with respect to 100 parts by weight of the brilliant toner particles.

Yellow Colorant

Examples of the yellow colorant include monoazo pigments such as C.I.Pigment Yellow 1, C.I.Pigment Yellow 2, C.I.Pigment Yellow 3, C.I.Pigment Yellow 5, C.I.Pigment Yellow 6, C.I.Pigment Yellow 49, C.I.Pigment Yellow 65, C.I.Pigment Yellow 73, C.I.Pigment Yellow 74, C.I.Pigment Yellow 75, C.I.Pigment Yellow 97, C.I.Pigment Yellow 98, C.I.Pigment Yellow 111, C.I.Pigment Yellow 116 and C.I.Pigment Yellow 130, disazo condensed pigments such as C.I.Pigment Yellow 93, C.I.Pigment Yellow 94, C.I.Pigment Yellow 95, C.I.Pigment Yellow 128, and C.I.Pigment Yellow 166, disazo pigments such as C.I.Pigment Yellow 12, C.I.Pigment Yellow 13, C.I.Pigment Yellow 14, C.I.Pigment Yellow 17, C.I.Pigment Yellow 55, C.I.Pigment Yellow 63, C.I.Pigment Yellow 81, C.I.Pigment Yellow 83, C.I.Pigment Yellow 87, C.I.Pigment Yellow 90, C.I.Pigment Yellow 106, C.I.Pigment Yellow 113, C.I.Pigment Yellow 114, C.I.Pigment Yellow 121, C.I.Pigment Yellow 124, C.I.Pigment Yellow 126, C.I.Pigment Yellow 127, C.I.Pigment Yellow 136, C.I.Pigment Yellow 152, C.I.Pigment Yellow 170, C.I.Pigment Yellow 171, C.I.Pigment Yellow 172, C.I.Pigment Yellow 174, C.I.Pigment Yellow 176, C.I.Pigment Yellow 180, and 188, and inorganic yellow pigments such as chrome yellow, C.I.Pigment Yellow zinc yellow, yellow iron oxide, and cadmium yellow. Among these, C.I.Pigment Yellow 74, C.I.Pigment Yellow 93, and C.I.Pigment Yellow 180 are preferably used as a yellow colorant from the viewpoint of dispersibility and easiness of the generation of fogging of the yellow toner due to the spread of the charging distribution.

Other Colorants

In this exemplary embodiment, for the toner particles, colorants other than the above-described yellow colorant may be used in combination. The colorant is not particularly limited as long as it is a known colorant, and examples thereof include carbon blacks such as furnace black, channel black, acetylene black, and thermal black, inorganic pigments such as red iron oxide, Prussian blue, and titanium oxide, azo pigments such as pyrazolone red, chelate red, brilliant carmine, and para brown, phthalocyanine pigments such as copper phthalocyanine and metal-free phthalocyanine, condensed polycyclic pigments such as dibromoanthrone orange, perylene red, quinacridone red, and dioxazine violet, naphthol magenta pigments, quinacridone magenta pigments, diketopyrrolopyrrole magenta pigments, and indigo magenta pigments.

Other colorants may be used alone, or in combination of two or more kinds thereof.

Binder Resin

Examples of the binder resin include ethylene resins such as polyester, polyethylene, and polypropylene; styrene resins such as polystyrene and α-polymethylstyrene; (meth)acrylic resins such as polymethyl methacrylate and polyacrylonitrile; polyamide resins, polycarbonate resins, polyether resins, and copolymer resins thereof.

These binder resins may be used alone, or in combination of two or more kinds thereof. Among these binder resins, a polyester resin is preferably used. As the polyester resin, for example, known polyester resins are exemplified.

Examples of the polyester resin include a condensation polymer of a polyvalent carboxylic acid and a polyol. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyols may be used singly, or in combination of two or more kinds thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K-1987 "testing methods for transition temperatures of plastics".

The weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed using HLC-8120, GPC which is manufactured by Tosoh Corporation as a measuring device, TSK gel Super HM-M (15 cm), which is column manufactured by Tosoh Corporation, and a THF solvent. The weight-average molecular weight and the number-average molecular weight are calculated using a molecular weight calibration curve plotted from a monodisperse polystyrene standard sample from the results of the foregoing measurement.

A known manufacturing method is used to obtain the polyester resin. Specific examples thereof include a method of conducting a reaction at a polymerization temperature set to from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably from 40% by weight to 95% by weight, more preferably from 50% by weight to 90% by weight, and even more preferably from 60% by weight to 85% by weight with respect to all of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K-1987 "testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to all of the toner particles.

Other Additives

Examples of other additives include known additives such as a magnetic material, a charge-controlling agent, and an inorganic powder. The toner particles include these additives as internal additives.

Characteristics of Toner Particles

The toner particles may be toner particles having a single-layer structure, or toner particles having a so-called core-shell structure configured to have a core (core particle) and a coating layer (shell layer) coated on the core.

Here, preferably, the toner particles having a core-shell structure may be configured to have, for example, a core including a binder resin, and if necessary other additives such as a colorant and a release agent, and a coating layer configured to include a binder resin.

Average Maximum Thickness C and Average Equivalent Circle Diameter D of Brilliant Toner Particles As shown in the requirement (1), the brilliant toner particles preferably have an average equivalent circle diameter D larger than the average maximum thickness C. A ratio (C/D) of the average maximum thickness C to the average equivalent circle diameter D is more preferably from 0.001 to 0.500, even more preferably from 0.010 to 0.200, and especially preferably from 0.050 to 0.100.

When the ratio (C/D) is 0.001 or greater, toner strength is secured and a fracture that is caused due to a stress in the image formation is thus prevented, whereby a reduction in charges that is caused by exposure of the pigment, and fogging that is caused as a result thereof are prevented. On the other hand, when the ratio (C/D) is 0.500 or less, excellent brilliance is obtained.

The average maximum thickness C and the average equivalent circle diameter D are measured using the following method.

Toner particles are placed on a smooth surface and uniformly dispersed by applying vibrations. 1,000 toner particles are observed with a color laser microscope "VK-9700" (manufactured by Keyence Corporation) at a magnification of 1,000 times to measure a maximum thickness C and an equivalent circle diameter D of a surface viewed from the top in the brilliant toner particles, and arithmetic averages thereof are obtained to calculate the average maximum thickness C and the average equivalent circle diameter D.

Angle Between Long Axis Direction of Brilliant Toner Particles in Cross-Sections and Long Axis Direction of Brilliant Pigment Particles As shown in the requirement (2), when cross-sections of the brilliant toner particles in a thickness direction are observed, the ratio (based on the number) of brilliant pigment particles that are present so that an angle between a long axis direction of the brilliant toner particles in the cross-sections and a long axis direction of the brilliant pigment particles is from −30° to +30° is preferably 60% or greater of the total number of brilliant pigment particles that are observed. The ratio is more preferably from 70% to 95%, and especially preferably from 80% to 90%.

When the ratio is 60% or greater, excellent brilliance is obtained.

Here, a method of observing cross-sections of brilliant toner particles will be described. A method of preparing an observation sample is the same as the above-described "method of observing cross-sections of individual toner particles to confirm whether the brilliant pigment is contained and whether the yellow colorant is contained in all of the toner particles".

The observation sample obtained using the above-described method is observed with a transmission electron microscope (TEM) at a magnification of approximately 5,000 times to observe cross sections of the brilliant toner particles. As for the observed 1,000 brilliant toner particles, the number of brilliant pigment particles that are present so that the angle between the long axis direction of the brilliant toner particles in the cross-sections and the long axis direction of the brilliant pigment particles is from −30° to +30° is counted using image analysis software, and the ratio thereof is calculated.

The "long axis direction of the brilliant toner particles in the cross-sections" indicates a direction perpendicular to the thickness direction of the brilliant toner particles having an average equivalent circle diameter D larger than an average maximum thickness C. The "long axis direction of the brilliant pigment particles" indicates a length direction of the brilliant pigment particles.

A shape factor SF1 of the toner particles not containing the brilliant pigment is preferably from 110 to 150, and more preferably from 120 to 140.

The shape factor SF1 is obtained through the following Expression.

Expression: $SF1=(ML^2/A)\times(\pi/4)\times100$

In the foregoing Expression, ML represents an absolute maximum length of the toner, and A represents a projected area of the toner.

Specifically, the shape factor SF1 is digitalized by mainly analyzing a microscopic image or a scanning electron microscopic (SEM) image using an image analyzer and is calculated as follows. That is, an optical microscopic image of particles scattered on slide glass is loaded to a Luzex image analyzer through a video camera to obtain maximum lengths and projected areas of 100 particles to thereby calculate shape factors SF1 through the foregoing Expression, and an average value thereof is obtained.

The number average particle diameter of the brilliant toner particles is preferably from 1 μm to 30 μl, and more preferably from 3 μm to 15 μm. The number average particle diameter of the yellow toner particles is preferably from 0.5 μm to 20 μm, and more preferably from 2 μm to 10 μm.

In the measurement of the number average particle diameters of the brilliant toner particles and the yellow toner particles, using the above-described method of determining whether the toner particles include a brilliant pigment, cross-sections of 5,000 toner particles are observed to measure particle diameters and an average thereof is obtained for each of the cases of the brilliant toner particles and the yellow toner particles. When the brilliant toner particles have a flake shape, an arithmetical mean value of the long axis diameter and the short axis diameter in the cross-section of a brilliant toner particle is "particle diameter".

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The inorganic particles as an external additive may have a surface treated with a hydrophobizing agent. The hydrophobizing treatment is performed by, for example, dipping inorganic particles in a hydrophobizing agent. The hydrophobizing agent is not particularly limited, and examples thereof include silane coupling agents, silicone oils, titanate coupling agents, and aluminum coupling agents. These may be used alone, or in combination of two or more kinds thereof.

In general, the amount of the hydrophobizing agent is, for example, from 1 part by weight to 10 parts by weight with respect to 100 parts by weight of the inorganic particles.

Examples of the external additive include resin particles (resin particles such as polystyrene particles, PMMA particles, and melamine resin particles) and cleaning activators (e.g., particles of metal salts of higher fatty acids represented by zinc stearate and particles of fluorine polymers).

The amount of the external additive externally added is, for example, preferably from 0.01% by weight to 5% by weight, and more preferably from 0.01% by weight to 2.0% by weight with respect to the toner particles.

Method of Preparing Toner

Next, a method of manufacturing the toner according to this exemplary embodiment will be described.

The toner according to this exemplary embodiment is obtained by manufacturing toner particles and by then externally adding an external additive to the toner particles.

Although the toner according to this exemplary embodiment contains the brilliant toner particles and the yellow toner particles, an external additive may be externally added to the toner particles containing both of the brilliant toner particles and the yellow toner particles, or the brilliant toner particles and the yellow toner particles may be mixed with each other after external addition of an external additive thereto.

In the manufacturing of the toner particles, the toner particles containing both of the brilliant toner particles and the yellow toner particles may be manufactured at once using a brilliant pigment and a yellow colorant, or the brilliant toner particles and the yellow toner particles may be separately manufactured and then mixed with each other.

Hereinafter, a method of manufacturing toner particles containing both of the brilliant toner particles and the yellow toner particles at once using a brilliant pigment (hereinafter, may be referred to as "metallic pigment") and a yellow colorant will be described.

The method of manufacturing toner particles is not particularly limited, and toner particles are prepared by known methods including a dry method such as a kneading and pulverizing method or a wet method such as an emulsion aggregating method and a dissolution and suspension method.

The kneading and pulverizing method is a method including mixing materials such as a metallic pigment with each other, melting and kneading the materials with a kneader, an extruder or the like, roughly pulverizing the obtained melted and kneaded product, performing pulverization using a jet mill or the like, and performing classification using a wind classifier to obtain toner particles having a target particle diameter.

More specifically, the kneading and pulverizing method is divided into a kneading step of kneading a toner forming material including a metallic pigment, a yellow colorant, and a binder resin and a pulverization step of pulverizing the kneaded product. If necessary, the kneading and pulverizing method may further include other steps such as a cooling step of cooling the kneaded product formed through the kneading step.

The dissolution and suspension method is a method including performing granulation in a water medium containing an inorganic dispersing agent using a liquid in which materials including a binder resin, a metallic pigment, a yellow colorant, and other components such as a release agent that are used if necessary are dissolved or dispersed in a solvent capable of dissolving the binder resin, and removing the solvent to obtain toner particles.

Examples of other components that are used in the dissolution and suspension method include various components such as a charge-controlling agent and inorganic particles, other than the release agent.

In this exemplary embodiment, an emulsion aggregating method may be used in which the shape and the particle diameter of toner particles are easily controlled and the control range in the structure of toner particles such as a core-shell structure is thus also wide. Hereinafter, a method of manufacturing toner particles using an emulsion aggregating method will be described in detail.

The emulsion aggregating method according to this exemplary embodiment has an emulsification step of emulsifying raw materials of toner particles to form resin particles (emulsified particles) or the like, an aggregation step of forming aggregates of the resin particles, and a coalescence step of coalescing the aggregates.

Emulsification Step

A resin particle dispersion may be prepared using a general polymerization method such as an emulsification and polymerization method, a suspension and polymerization method, or a dispersion and polymerization method. Otherwise, a resin particle dispersion may be prepared through emulsification by applying a shear force to a solution obtained by mixing an aqueous medium with a binder resin using a dispersing machine. In this case, particles may be formed by reducing the viscosity of the resin component by heating. In addition, a dispersing agent may be used in order to stabilize the dispersed resin particles. Furthermore, when a resin is dissolved in an oily solvent having a relatively low solubility in water, the resin is dissolved in the solvent so that particles thereof are dispersed in the water together with a dispersing agent or a polyelectrolyte, and then heating or decompression is performed to transpire the solvent, thereby preparing a resin particle dispersion.

Examples of the aqueous medium include water such as distilled water and ion exchange water; and alcohols. Water is preferably used.

Examples of the dispersing agent used in the emulsification step include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants such as anionic surfactants, e.g., sodium dodecylbenzenesulfonate, sodium octadecylsulfate, sodium oleate, sodium laurate, and potassium stearate, cationic surfactants, e.g., laurylamine acetate, stearyl amine acetate, and lauryl trimethyl ammonium chloride, zwitterionic surfactants, e.g., lauryl dimethyl amine oxide, and nonionic surfactants, e.g., polyoxyethylene alkyl ether, polyoxyethylene alkyl phenyl ether, and polyoxyethylene alkylamine; and inorganic salts such as tricalcium phosphate, aluminum hydroxide, calcium sulfate, calcium carbonate, and barium carbonate.

Examples of the dispersing machine used in the preparation of the emulsified liquid include a homogenizer, a homomixer, a pressure kneader, an extruder, and a media-dispersing machine. The size of the resin particles is preferably 1.0 μm or less, more preferably from 60 nm to 300 nm, and even more preferably from 150 nm to 250 nm in terms of the average particle diameter (volume average particle diameter). When the diameter is 60 nm or greater, the resin particles easily become unstable in the dispersion, and thus the resin particles may easily aggregate. When the diameter is 1.0 μm or less, the particle diameter distribution of the toner may be narrowed.

In the preparation of a release agent dispersion, a release agent is dispersed in water, together with an ionic surfactant or a polyelectrolyte such as a polymer acid or a polymer base, and then a dispersion treatment is performed using a homogenizer or a pressure discharge-type dispersing machine with which a strong shear force is applied thereto, simultaneously with heating to a temperature that is not lower than the melting temperature of the release agent. A release agent dispersion is obtained through such a treatment.

Through the dispersion treatment, a release agent dispersion containing release agent particles having a volume average particle diameter of 1 μm or less is obtained. More preferably, the volume average particle diameter of the release agent particles is from 100 nm to 500 nm.

When the volume average particle diameter is 100 nm or greater, though there is also an effect of the characteristics of the binder resin to be used, generally, the release agent component is easily incorporated in the toner. When the volume average particle diameter is 500 nm or less, the release agent in the toner has a superior dispersion state.

In order to prepare a metallic pigment dispersion, a known dispersion method may be used and a general dispersion unit such as a rotary shearing-type homogenizer, a ball mill having media, a sand mill, a Dyno mill, or an Altimizer may be employed. There are no limitations to the dispersion unit. The metallic pigment is dispersed in water, together with an ionic surfactant or a polyelectrolyte such as a polymer acid or a polymer base. The volume average particle diameter of the dispersed metallic pigment may be 20 μm or less. The volume average particle diameter is preferably from 3 μm to 16 μm, since the metallic pigment in the toner is dispersed well with no impairment in aggregability.

A known dispersion method may be used to prepare a yellow colorant dispersion, and a general dispersion unit such as a rotary shearing-type homogenizer, a ball mill having media, a sand mill, a Dyno mill, or an Altimizer may be employed. There are no limitations to the dispersion unit. If necessary, an aqueous dispersion of a yellow colorant may be prepared using a surfactant, or an organic solvent dispersion of a yellow colorant may be prepared using a dispersing agent. As the surfactant or the dispersing agent used in the dispersion, a dispersing agent which is the same as that which may be used in the dispersion of the binder resin may be used.

In addition, a metallic pigment, a binder resin, and a yellow colorant may be dispersed and dissolved to be mixed with each other in a solvent to disperse the foregoing materials in the water by phase inversion emulsification or shearing emulsification, thereby preparing a dispersion of the metallic pigment coated with the binder resin and the yellow colorant coated with the binder resin.

In addition, a known dispersion method may be used to prepare dispersions of colorants other than the yellow colorant in the same manner as in the case of the yellow colorant, and there are no limitations to the method.

Aggregation Step

In the aggregation step, a resin particle dispersion, a metallic pigment dispersion, a yellow colorant dispersion, a release agent dispersion, and the like are mixed to prepare a mixture, and heated at a temperature that is not higher than the glass transition temperature of the resin particles to aggregate the resin particles, thereby forming aggregated particles. In many cases, in order to form the aggregated particles, the pH of the mixture is adjusted to acidic under stirring. By virtue of the above stirring conditions, the ratio (C/D) may be adjusted within a preferable range. More specifically, in the aggregated particle forming stage, when rapid stirring and heating are performed, the ratio (C/D) may be reduced, and when the stirring speed is reduced and the heating is performed at lower temperature, the ratio (C/D) may be increased. The pH is preferably from 2 to 7, at which an aggregating agent may also be effectively used.

Furthermore, in the aggregation step, the release agent dispersion may be added and mixed together with various dispersions such as a resin particle dispersion at once or in several portions.

As the aggregating agent, a di- or higher-valent metal complex is preferably used, as well as a surfactant having an opposite polarity of the polarity of the surfactant that is used as the dispersing agent, and an inorganic metal salt. Since the amount of the surfactant to be used may be reduced and the charging characteristics are improved, a metal complex is especially preferably used.

As the inorganic metal salt, aluminum salts and polymers thereof are especially preferable. In order to obtain a narrower particle size distribution, the valence of the inorganic metal salt is more preferably divalent than monovalent, trivalent than divalent, or tetravalent than trivalent, and further, in the case of the same valences as each other, a polymer-type inorganic metal salt polymer is more suitable.

In this exemplary embodiment, a polymer of tetravalent inorganic metal salt including aluminum is preferably used to obtain a narrow particle size distribution.

In addition, when the aggregated particles have a desired particle diameter, the resin particle dispersion may be further added (coating step) to prepare a toner having a configuration in which a surface of a core aggregated particle is coated with a resin. In this case, the release agent or the metallic pigment is not easily exposed to the toner surface, and thus the configuration is preferable from the viewpoint of charging properties and developability. In the case of further addition, an aggregating agent may be added or the pH may be adjusted before further addition.

Coalescence Step

In the coalescence step, the progression of the aggregation is stopped by increasing the pH of the suspension of the aggregated particles to a range of from 3 to 9 under stirring conditions based on the aggregation step, and the aggregated particles are coalesced by heating at a temperature that is not lower than the glass transition temperature of the resin.

In addition, in the case of coating with the resin, the resin is also coalesced and the core aggregated particles are coated therewith. Regarding the heating time, the heating may be performed to the extent that the coalescence is caused, and may be performed for, approximately, from 0.5 hours to 10 hours.

After coalescence, cooling is performed to obtain coalesced particles. In addition, in the cooling step, crystallization may be promoted by lowering the cooling rate at around the glass transition temperature of the resin (glass transition temperature ±10° C.), that is, so-called slow cooling.

The coalesced particles obtained by coalescence are subjected to a solid-liquid separation step such as filtration, and if necessary, a washing step and a drying step, and thus toner particles are obtained.

In the manufacturing method, in order to adjust the ratio of toner particles containing a yellow colorant without containing a brilliant pigment in the toner particles not containing the brilliant pigment to 50% by number or greater, for example, an aggregation promotion step of preparing a dispersion of first aggregated particles containing a brilliant pigment, a yellow colorant, and a first binder resin by mixing a brilliant pigment dispersion containing the brilliant pigment, a yellow colorant dispersion, and a first binder resin particle dispersion containing the first binder resin, and mixing the dispersion of the first aggregated particles with a second binder resin particle dispersion containing a second binder resin so that a ratio (based on the weight) between the first binder resin and the second binder resin is from 3:97 to 48:52, thereby promoting the aggregation of the first aggregated particles and the second aggregated particles, and a coalescence step of coalescing the first aggregated particles and the second aggregated particles by heating may be conducted to manufacture a brilliant toner. In addition, toner particles containing a brilliant pigment and toner particles containing a yellow colorant without containing the brilliant pigment may be separately prepared, and ratios of the toner particles containing the brilliant pigment and the toner particles containing the yellow colorant without containing the brilliant pigment to be added may be adjusted so that the ratio of the toner particles containing the yellow colorant without containing the brilliant pigment is 50% by number or greater, to obtain the brilliant toner according to this exemplary embodiment.

In addition, in order to adjust the content of the yellow colorant of the brilliant toner to from 10 parts by weight to 70 parts by weight with respect to 100 parts by weight of the brilliant pigment, a brilliant pigment dispersion and a yellow colorant dispersion may be mixed so that a ratio (based on the weight) between the brilliant pigment and the yellow colorant is from 100:10 to 100:70. The ratio between the brilliant pigment and the yellow colorant is preferably from 100:20 to 100:60, and more preferably from 100:30 to 100:50.

In order to adjust the ratio of toner particles not containing the brilliant pigment in all of the toner particles to 80% by number or less, for example, a first aggregated particle dispersion preparation step of preparing a dispersion of first aggregated particles containing a brilliant pigment and a first binder resin by mixing a brilliant pigment dispersion containing the brilliant pigment and a first binder resin particle dispersion containing the first binder resin, a second aggregated particle dispersion preparation step of preparing a dispersion of second aggregated particles containing a second binder resin using a second binder resin particle dispersion containing the second binder resin, an aggregation promotion step of promoting the aggregation of the first aggregated particles and the second aggregated particles by mixing the dispersion of the first aggregated particles and the dispersion of the second aggregated particles so that a ratio (based on the weight) between the first binder resin and the second binder resin is from 3:97 to 48:52, and a coalescence step of coalescing the first aggregated particles and the second aggregated particles by heating may be conducted to manufacture a brilliant toner.

The ratio (based on the weight) between the first binder resin and the second binder resin is preferably from 6:94 to 30:70, and more preferably from 9:91 to 24:76.

In the steps of preparing the first and second aggregated particle dispersions, the kinds of the first binder resin and the second binder resin may be the same as or different from each other.

When the yellow toner particles and the brilliant toner particles are separately manufactured, the brilliant toner particles are manufactured using the same method as the method of manufacturing toner particles containing both of the brilliant toner particles and the yellow toner particles at once, except for using only a metallic pigment. The yellow toner particles are manufactured using the same method as the method of manufacturing toner particles containing both of the brilliant toner particles and the yellow toner particles at once, except for using only a yellow colorant. The brilliant toner particles and the yellow toner particles are mixed with each other.

The volume average particle diameter of the yellow colorant particles in the yellow colorant particle dispersion in which the yellow colorant particles are dispersed is preferably from 0.01 μm to 1 μm, more preferably from 0.08 μm to 0.8 μm, and even more preferably from 0.1 μm to 0.6 μm.

The toner according to this exemplary embodiment is manufactured by, for example, adding and mixing an external additive with dried toner particles. The mixing may preferably be performed using, for example, a V-blender, a Henschel mixer, a Loedige mixer or the like. Furthermore, if necessary, coarse toner particles may be removed using a vibration sieving machine, a wind classifier, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, a fixing unit that fixes the toner image transferred onto the surface of the recording medium, and a cleaning unit that has a cleaning blade to clean the surface of the image holding member. As the electrostatic charge image developer, the electrostatic charge image developer according to this exemplary embodiment is applied.

In the image forming apparatus according to this exemplary embodiment, an image forming method (image forming method according to this exemplary embodiment) including a charging step of charging a surface of an image holding member, an electrostatic charge image forming step of forming an electrostatic charge image on the charged surface of the image holding member, a developing step of developing the electrostatic charge image formed on the surface of the image holding member with the electrostatic charge image developer according to this exemplary embodiment to form a toner image, a transfer step of transferring the toner image formed on the surface of the image holding member onto a surface of a recording medium, a cleaning step of cleaning the surface of the image holding member using a cleaning blade, and a fixing step of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; or an apparatus that is provided with an erasing unit that irradiates, after transfer of a toner image and before charging, a surface of an image holding member with erasing light for erasing.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

Figure 2:
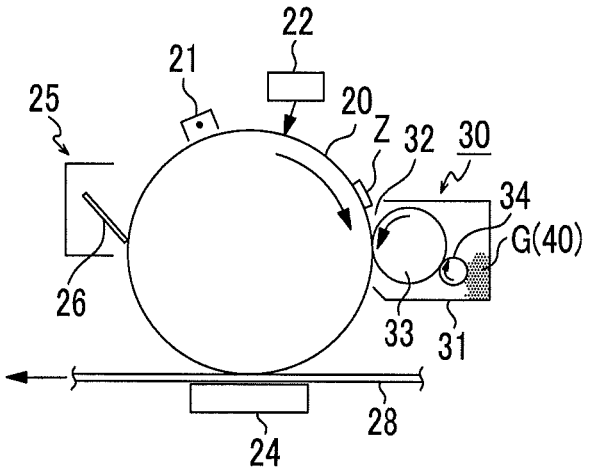
FIG. 2 is a schematic diagram showing a configuration of an example of an image forming apparatus according to the exemplary embodiment.

FIG. 2 is a schematic diagram showing a configuration of an example of the image forming apparatus according to this exemplary embodiment including a developing device to which the electrostatic charge image developer according to this exemplary embodiment is applied.

In FIG. 2, the image forming apparatus according to this exemplary embodiment has a photoreceptor 20 as an image holding member rotating in a predetermined direction. A charging device 21 (an example of the charging unit) that charges the photoreceptor 20 (an example of the image holding member), an exposure device 22 (an example of the electrostatic charge image forming unit) as an electrostatic charge image forming device that forms an electrostatic charge image Z on the photoreceptor 20, a developing device 30 (an example of the developing unit) that visualizes the electrostatic charge image Z formed on the photoreceptor 20, a transfer device 24 (an example of the transfer unit) that transfers the toner image visualized on the photoreceptor 20 onto a recording sheet 28 as a recording medium, and a cleaning device 25 (an example of the cleaning unit) that cleans the toner remaining on the photoreceptor 20 using a cleaning blade 26 are arranged in sequence around the photoreceptor 20.

In this exemplary embodiment, as shown in FIG. 2, the developing device 30 has a developing housing 31 that accommodates an electrostatic charge image developer G including a toner 40. This developing housing 31 has a developing opening 32 formed to be opposed to the photoreceptor 20, and a developing roll (developing electrode) 33 as a toner holding member arranged to face the developing opening 32. When a predetermined developing bias is applied to the developing roll 33, a developing electric field is formed in a region (developing region) sandwiched between the photoreceptor 20 and the developing roll 33. Furthermore, in the developing housing 31, a charge injection roll (injection electrode) 34 as a charge injection member is provided to be opposed to the developing roll 33. Particularly, in this exemplary embodiment, the charge injection roll 34 also acts as a toner supply roll for supplying the toner 40 to the developing roll 33.

Here, the rotation direction of the charge injection roll 34 may be selected, but in consideration of supply properties of the toner and charge injection properties, it is preferable that the charge injection roll 34 be rotated in the same direction as that of the developing roll 33 at a part opposed to the developing roll 33 with a difference in the peripheral velocity (for example, 1.5 times or greater), and the toner 40 be held in a region sandwiched between the charge injection roll 34 and the developing roll 33 and rubbed to inject charges.

Next, an operation of the image forming apparatus according to the exemplary embodiment will be described.

When an image forming process is started, first, the surface of the photoreceptor 20 is charged by the charging device 21, the exposure device 22 records an electrostatic charge image Z on the charged photoreceptor 20, and the developing device 30 visualizes the electrostatic charge image Z as a toner image. Then, the toner image on the photoreceptor 20 is transported to a transfer site, and the transfer device 24 electrostatically transfers the toner image on the photoreceptor 20 onto a recording sheet 28 as a recording medium. The toner remaining on the photoreceptor 20 is cleaned by the cleaning device 25 having the cleaning blade 26. Thereafter, the toner image on the recording sheet 28 is fixed by a fixing device (an example of the fixing unit), and thus an image is obtained.

Process Cartridge/Toner Cartridge

A process cartridge according to this exemplary embodiment will be described.

The process cartridge according to this exemplary embodiment is a process cartridge that is detachable from an image forming apparatus and is provided with a developing unit that accommodates the electrostatic charge image developer according to this exemplary embodiment and develops an electrostatic charge image formed on a surface of an image holding member with the electrostatic charge image developer to form a toner image.

The process cartridge according to this exemplary embodiment is not limited to the above-described configuration, and may be configured to include a developing device, and if necessary, for example, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 3:
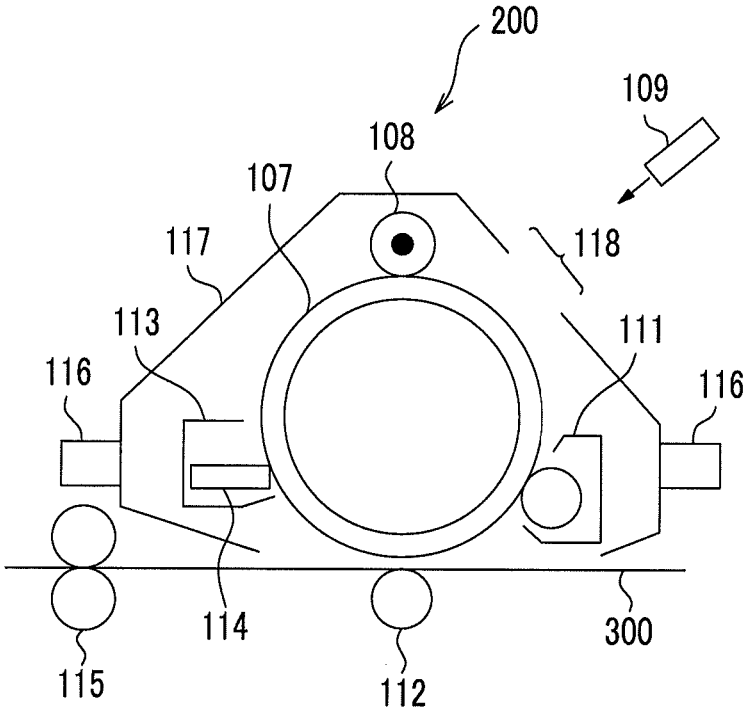
FIG. 3 is a schematic diagram showing a configuration of an example of a process cartridge according to the exemplary embodiment.

FIG. 3 is a schematic diagram showing a configuration of the process cartridge according to the exemplary embodiment.

A process cartridge 200 shown in FIG. 3 is configured by integrally combining and holding a photoreceptor 107 (an example of the image holding member), and a charging roller 108 (an example of the charging unit), a developing device 111 (an example of the developing unit), and a photoreceptor cleaning device 113 (an example of the cleaning unit) having a cleaning blade 114 which are provided around the photoreceptor 107, by the use of, for example, a housing 117 having a mounting rail 116 and an opening 118 for exposure, and is thus made as a cartridge.

In FIG. 3, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described. The toner cartridge according to this exemplary embodiment may be configured to contain the brilliant toner according to this exemplary embodiment and to be detachable from an image forming apparatus. The toner cartridge according to this exemplary embodiment may accommodate a toner, or for example, an electrostatic charge image developer may be accommodated according to the mechanism of the image forming apparatus.

The image forming apparatus shown in FIG. 2 is an image forming apparatus having such a configuration that a toner cartridge (not shown) is detachable therefrom, and the developing device 30 is connected to the toner cartridge via a toner supply tube (not shown). When the amount of the toner accommodated in the toner cartridge is small, the toner cartridge may be replaced.

EXAMPLES

Hereinafter, this exemplary embodiment will be described in detail using examples, but is not limited to the examples. In the following description, unless otherwise specifically noted, "parts" and "%" are based on the weight.

Preparation of Toner

Synthesis of Binder Resin (1)

Synthesis of Binder Resin

Terephthalic Acid: 190 parts

Ethylene Oxide 2-Mol Adduct of Bisphenol A: 216 parts

Ethylene Glycol: 32 parts

Propylene Glycol: 6 parts

Tetrabutoxy Titanate: 0.037 part

The above components are put into a heat-dried two-necked flask, and the temperature is increased while the components are stirred in an inert atmosphere with a nitrogen gas supplied to the container. Then, the obtained material is subjected to a co-condensation polymerization reaction for 7 hours at 160° C., and then while the pressure is slowly reduced to 1.3 kPa, the temperature is increased to 220° C. and the material is held for 4 hours. The pressure is once returned to the ordinary pressure ($1.0\times10^2$ kPa), and 9 parts of trimellitic anhydride is added. The pressure is slowly reduced again to 1.3 KPa, and the material is held for 1 hour at 220° C., whereby a binder resin is synthesized.

Preparation of Resin Particle Dispersion

Binder Resin: 160 parts

Ethyl Acetate: 230 parts

Sodium Hydroxide Aqueous Solution (0.3 N): 0.1 part

The above components are put into a 1,000 ml separable flask, heated at 70° C., and stirred using a three-one motor (manufactured by Shinto Scientific Co., Ltd.) to prepare a resin mixture. During further stirring of this resin mixture, 373 parts of ion exchange water is slowly added thereto to perform phase inversion emulsification, and the solvent is removed. Thus, a resin particle dispersion (solid content concentration: 30%) is prepared.

Preparation of Release Agent Dispersion

Carnauba Wax (manufactured by Toa Kasei Co., Ltd., RC-160): 50 parts

Anionic Surfactant (manufactured by Dai-Ichi Kogyo Seiyaku Co., Ltd., Neogen RK): 1.0 part Ion Exchange Water: 200 parts The above components are mixed and heated at 95° C. and the mixture is dispersed using a homogenizer (manufactured by IKA-Werke GmbH & Co. KG, Ultra Turrax T50). Then, a dispersion treatment is performed for 6 hours using a Manton Gaulin high-pressure homogenizer (manufactured by Gaulin Corporation) to prepare a release agent dispersion (solid content concentration: 20%) in which release agent particles are dispersed.

Preparation of Brilliant Pigment Dispersion

Aluminum Pigment (manufactured by Showa Aluminum Corporation, 2173EA): 100 parts Anionic Surfactant (manufactured by Dai-Ichi Kogyo Seiyaku Co., Ltd., Neogen R): 1.5 parts Ion Exchange Water: 400 parts The above components are mixed after removing a solvent from an aluminum pigment paste, and are dispersed for 1 hour using an emulsification dispersing machine Cavitron (manufactured by Pacific Machinery & Engineering Co., Ltd., CR1010), thereby preparing a brilliant pigment dispersion (solid content concentration: 20%) in which the brilliant pigment (aluminum pigment) is dispersed.

Preparation of Yellow Colorant Dispersion 1

C.I.Pigment Yellow 74 (manufactured by Dainichiseika Color & Chemicals Mfg. Co., Ltd.): 50 parts Ionic Surfactant Neogen RK (manufactured by Dai-Ichi Kogyo Seiyaku Co., Ltd.): 5 parts Ion Exchange Water: 193 parts The above components are mixed and processed for 10 minutes at 240 MPa using an ultimizer (manufactured by Sugino Machine Ltd.) to prepare a yellow colorant dispersion 1 (solid content concentration: 20%).

Preparation of Yellow Colorant Dispersion 2

A yellow colorant dispersion 2 (solid content concentration: 20%) is prepared in the same manner as in the case of the preparation of the yellow colorant dispersion 1, except that the colorant is changed to 50 parts of C.I.Pigment Yellow 93 (manufactured by Dainichiseika Color & Chemicals Mfg. Co., Ltd.).

Preparation of Yellow Colorant Dispersion 3

A yellow colorant dispersion 3 (solid content concentration: 20%) is prepared in the same manner as in the case of the preparation of the yellow colorant dispersion 1, except that the colorant is changed to 50 parts of C.I.Pigment Yellow 180 (manufactured by Dainichiseika Color & Chemicals Mfg. Co., Ltd.).

Preparation of Red Colorant Dispersion

A red colorant dispersion (solid content concentration: 20%) is prepared in the same manner as in the case of the preparation of the yellow colorant dispersion 1, except that the colorant is changed to 50 parts of C.I.Pigment Red 238 (manufactured by Sanyo Color Works, Ltd.), which is a naphthol magenta pigment.

Example 1

Preparation of Brilliant Toner 1

Resin Particle Dispersion: 480 parts

Release Agent Dispersion: 100 parts

Brilliant Pigment Dispersion: 200 parts

Yellow Colorant Dispersion 1: 60 parts

Nonionic Surfactant (IGEPAL CA897): 1.40 parts

The above components are put into a 2 L cylindrical stainless-steel container, and dispersed and mixed for 10 minutes at 4,000 rpm using a homogenizer (manufactured by IKA-Werke GmbH & Co. KG, Ultra Turrax T50) while applying a shear force.

Next, to the mixture, 1.75 parts of a 10% nitric acid aqueous solution of polyaluminum chloride is slowly added dropwise as an aggregating agent, and the mixture is dispersed and mixed for 15 minutes at a number of revolutions of the homogenizer of 5,000 rpm. Thus, an aggregated particle dispersion is prepared.

Next, the aggregated particle dispersion is transferred to a polymerization vessel provided with a thermometer and a stirrer using a stirring blade having two paddles for forming a laminar flow. Heating is started by a mantle heater at a number of stirring revolutions of 500 rpm to promote the growth of aggregated particles at 54° C. In this case, the pH of the raw material dispersion is controlled to from 2.2 to 3.5 with a 0.3 N nitric acid or a 1 N sodium hydroxide aqueous solution. The dispersion is held for approximately 2 hours at a pH in the above range. In this case, the volume average particle diameter of the aggregated particles measured using a Multisizer II (aperture diameter: 50 μm, manufactured by Beckman Coulter Inc.) is 10.2 μm.

Next, 100 parts of the resin particle dispersion is further added thereto to attach the resin particles to surfaces of the aggregated particles. The temperature is further increased to 56° C., and the aggregated particles are aligned while the size and the form of the particles are confirmed using an optical microscope and a Multisizer II.

Thereafter, in order to cause the aggregated particles to coalesce, the pH is increased to 8.0, and then the temperature is increased to 75° C. After the coalescence of the aggregated particles is confirmed with the optical microscope, the pH is decreased to 6.0 while the temperature is maintained at 75° C. After 1 hour, the heating is stopped and the particles are cooled at a rate of temperature decrease of 1.0° C./min. Thereafter, the particles are sieved through a 40 μm mesh, repeatedly washed with water, and then dried by a vacuum dryer, thereby obtaining toner particles. The volume average particle diameter of the obtained toner particles is 12.1 μm.

1.5 parts of hydrophobic silica (manufactured by Nippon Aerosil Co., Ltd., RY50) and 1.0 part of hydrophobic titanium oxide (manufactured by Nippon Aerosil Co., Ltd., T805) are mixed with 100 parts of the obtained toner particles using a sample mill at 10,000 rpm for 30 seconds. Thereafter, the mixture is sieved through a vibrating screen having openings of 45 μm to prepare a brilliant toner 1.

Example 2

Preparation of Brilliant Toner 2

A brilliant toner 2 is obtained in the same manner as in the case of the preparation of the brilliant toner 1, except that the amount of the yellow colorant dispersion 1 is changed from 60 parts to 140 parts.

Example 3

Preparation of Brilliant Toner 3

A brilliant toner 3 is obtained in the same manner as in the case of the preparation of the brilliant toner 1, except that the amount of the yellow colorant dispersion 1 is changed from 60 parts to 20 parts.

Example 4

Preparation of Brilliant Toner 4

A brilliant toner 4 is obtained in the same manner as in the case of the preparation of the brilliant toner 1, except that 10 parts of the red colorant dispersion is mixed in addition to the raw materials of the brilliant toner 1.

Example 5

Preparation of Brilliant Toner 5

A brilliant toner 5 is obtained in the same manner as in the case of the preparation of the brilliant toner 1, except that the amount of the yellow colorant dispersion 1 is changed from 60 parts to 150 parts.

Example 6

Preparation of Brilliant Toner 6

A brilliant toner 6 is obtained in the same manner as in the case of the preparation of the brilliant toner 1, except that 60 parts of the yellow colorant dispersion 1 is changed to 60 parts of the yellow colorant dispersion 2.

Example 7

Preparation of Brilliant Toner 7

A brilliant toner 7 is obtained in the same manner as in the case of the preparation of the brilliant toner 1, except that 60 parts of the yellow colorant dispersion 1 is changed to 60 parts of the yellow colorant dispersion 3.

Example 8

Preparation of Brilliant Toner 8

A yellow toner is obtained in the same manner as in the case of the preparation of the brilliant toner 1, except that 200 parts of the brilliant pigment dispersion is changed to 200 parts of the yellow colorant dispersion 1. 1 part of particles of this toner and 100 parts of the brilliant toner 1 are mixed with each other, and 1.5 parts of hydrophobic silica (manufactured by Nippon Aerosil Co., Ltd., RY50) and 1.0 part of hydrophobic titanium oxide (manufactured by Nippon Aerosil Co., Ltd., T805) are mixed therewith using a sample mill at 10,000 rpm for 30 seconds. Thereafter, the mixture is sieved through a vibrating screen having openings of 45 μm to obtain a brilliant toner 8.

Comparative Example 1

Preparation of Brilliant Toner R1

A brilliant toner R1 is obtained in the same manner as in the case of the preparation of the brilliant toner 1, except that 60 parts of the yellow colorant dispersion 1 is changed to 60 parts of the red colorant dispersion.

Comparative Example 2

Preparation of Brilliant Toner R2

A brilliant toner R2 is obtained in the same manner as in the case of the preparation of the brilliant toner 1, except that the amount of the yellow colorant dispersion is changed from 60 parts to 10 parts.

Regarding the brilliant toner 1 of Example 1, among toner particles not containing the brilliant pigment, the ratio of toner particles containing a yellow colorant without containing the brilliant pigment is calculated using the above-described method and its result is 85% by number. In addition, regarding the brilliant toner 1, the content of the yellow colorant is 30 parts with respect to 100 parts of the brilliant pigment. In addition, regarding the brilliant toner 1, among all of the toner particles, the ratio of toner particles not containing the brilliant pigment is calculated using the above-described method and its result is 40% by number.

In addition, regarding the brilliant toners of Examples 2 to 8 and Comparative Examples 1 and 2, the ratio of yellow toner particles, the content of the yellow colorant, and the ratio of toner particles not containing the brilliant pigment are calculated in the same manner as in the case of the brilliant toner 1 of Example 1. The results are summed up in Table 1.

EVALUATION

Preparation of Electrostatic Charge Image Developer 100 parts of ferrite particles (manufactured by Powdertech Co., Ltd., average particle diameter: 50 μm) and 1.5 parts of a methyl methacrylate resin (manufactured by Mitsubishi Rayon Co., Ltd., molecular weight: 95,000, the ratio of components of 10,000 or less is 5%) are put into a pressurizing kneader together with 500 parts of toluene, and are stirred to be mixed for 15 minutes at room temperature (for example, 25° C.). Then, while the mixing is performed under reduced pressure, the temperature is increased to 70° C. to remove the toluene, and then the mixture is cooled and classified using a 105 μm sieve to obtain a resin-coated ferrite carrier. This resin-coated ferrite carrier is mixed with each of the brilliant toners 1 to 8, R1, and R2 obtained in the respective examples, and thus electrostatic charge image developers 1 to 8, R1, and R2 having a toner concentration of 7% are prepared.

Evaluation of Deformation of Cleaning Blade and Color Stripes

Under a high temperature and high humidity of approximately 32° C. and 80% RH, the electrostatic charge image developer as a sample obtained in each example is supplied to a developing device of a modified machine of a DocuCentre-III C7600 manufactured by Fuji Xerox Co., Ltd., and an image having a printing area of 1.0% is formed on 10,000 recording sheets (OK Top Coat+ paper, manufactured by Oji Paper Co., Ltd.). Thereafter, the deformed state of a cleaning blade (material: polyurethane) and the generation of color stripes are visually evaluated with the following criteria. The results are shown in Table 1.

The evaluation standards are shown as follows.

A: There is no deformation of the cleaning blade and no color stripes are confirmed on the photoreceptor and the images.

B: The deformation of the cleaning blade is confirmed, but no color stripes are confirmed on the photoreceptor and the images.

C: The deformation of the cleaning blade is confirmed, and color stripes are confirmed on the photoreceptor, but not on the images.

D: The deformation of the cleaning blade and color stripes on the photoreceptor are confirmed, and slight color stripes are confirmed on the images.

E: The deformation of the cleaning blade and color stripes on the photoreceptor are confirmed, and color stripes are also confirmed on the images, whereby this level is not allowed.

Evaluation of Brilliance

Under a high temperature and high humidity of approximately 32° C. and 80% RH, the electrostatic charge image developer as a sample obtained in each example is supplied to a developing device of a modified machine of a DocuCentre-III C7600 manufactured by Fuji Xerox Co., Ltd., and an image having a printing area of 1.0% is formed on 10,000 recording sheets (OK Top Coat+ paper, manufactured by Oji Paper Co., Ltd.) at a fixing temperature of 190° C. and a fixing pressure of 4.0 kg/cm$^2$. Thereafter, a solid image having a toner amount of 4.5 g/cm$^2$ is formed. Regarding the obtained solid image, the brilliance is visually evaluated under illumination for color observation (natural daylight illumination) based on "testing methods for paints, Part 4: visual characteristics of film, Section 3: visual comparison of the color of paints" in JIS K5600-4-3: 1999. A particle feeling (shining brilliance effect) and an optical effect (change in the hue depending on the angle of view) are evaluated with the following standards. Level 2 or higher levels are judged as practically usable level. The results are shown in Table 1.

The evaluation standards are shown as follows.

5: The particle feeling and the optical effect are harmonized.

4: The particle feeling and the optical effect are observed.

3: Normal feeling

2: There is a blurred feeling.

1: There are no particle feeling and no optical effect.

TABLE 1

| | Ratio of Toner Particles Containing Yellow Colorant Without Containing Brilliant Pigment (% by number) | Content of Yellow Colorant with respect to 100 Parts of Brilliant Pigment (parts) | Ratio of Toner Particles Not Containing Brilliant Pigment (% by number) | Brilliance | Deformation of Cleaning Blade and Streaky Image Defects |
|---|---|---|---|---|---|
| Example 1 | 85 | 30 | 40 | 5 | A |
| Example 2 | 95 | 70 | 26 | 3 | B |
| Example 3 | 55 | 10 | 75 | 4 | B |
| Example 4 | 85 | 30 | 55 | 5 | B |
| Example 5 | 98 | 80 | 85 | 1 | C |

TABLE 1-continued

| | Ratio of Toner Particles Containing Yellow Colorant Without Containing Brilliant Pigment (% by number) | Content of Yellow Colorant with respect to 100 Parts of Brilliant Pigment (parts) | Ratio of Toner Particles Not Containing Brilliant Pigment (% by number) | Brilliance | Deformation of Cleaning Blade and Streaky Image Defects |
|---|---|---|---|---|---|
| Example 6 | 84 | 30 | 45 | 4 | B |
| Example 7 | 80 | 30 | 50 | 4 | B |
| Example 8 | 98 | 31 | 60 | 4 | A |
| Comparative Example 1 | 0 | 0 | 50 | 3 | E |
| Comparative Example 2 | 40 | 5 | 83 | 2 | E |

From the above results, it is found that in the examples, the generation of streaky image defects is suppressed, compared to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

toner particles containing a brilliant pigment; and toner particles not containing any brilliant pigment, wherein:

the toner particles not containing any brilliant pigment comprise toner particles containing a yellow pigment and not containing any brilliant pigment, and a percentage of the toner particles containing the yellow colorant and not containing any brilliant pigment in the toner particles not containing any brilliant pigment is 50% by number or greater.

2. The brilliant toner according to claim 1, wherein a content of the yellow colorant in the brilliant toner is from 10 parts by weight to 70 parts by weight with respect to 100 parts by weight of the brilliant pigment in the brilliant toner.

3. The brilliant toner according to claim 1, wherein a percentage of the toner particles not containing any brilliant pigment in the brilliant toner is 80% by number or less.

4. The brilliant toner according to claim 1, wherein a ratio (A/B) of a reflectance A at a light-receiving angle of +30° to a reflectance B at a light-receiving angle of −30° measured using a variable angle photometer when an image is irradiated with incident light at an incident angle of −45° is from 2 to 100.

5. The brilliant toner according to claim 1, wherein the toner particles containing the brilliant pigment have a flakier shape than the toner particles containing the yellow colorant and not containing any brilliant pigment.

6. The brilliant toner according to claim 1, wherein a content of the brilliant pigment in the toner particles containing the brilliant pigment is from 1 part by weight to 70 parts by weight with respect to 100 parts by weight of the toner particles containing the brilliant pigment.

7. The brilliant toner according to claim 1, wherein the brilliant pigment has a flake shape.

8. The brilliant toner according to claim 1, wherein the brilliant pigment includes aluminum.

9. The brilliant toner according to claim 1, wherein the yellow colorant includes at least any of C.I.Pigment Yellow 74, C.I.Pigment Yellow 93, and C.I.Pigment Yellow 180.

10. The brilliant toner according to claim 1, wherein the toner particles containing the yellow colorant and not containing any brilliant pigment have a more spherical shape than the toner particles containing the brilliant pigment.

11. The brilliant toner according to claim 1, wherein a shape factor SF1 of the toner particles not containing any brilliant pigment is from 110 to 150.

12. The brilliant toner according to claim 1, wherein the toner particles containing the yellow colorant and not containing any brilliant pigment have a smaller particle diameter than the toner particles containing the brilliant pigment.

13. The brilliant toner according to claim 1, wherein the toner particles containing the brilliant pigment contains a polyester resin.

14. The brilliant toner according to claim 13, wherein a glass transition temperature (Tg) of the polyester resin is from 50° C. to 80° C.

15. The brilliant toner according to claim 13, wherein a molecular weight distribution Mw/Mn of the polyester resin is from 1.5 to 100.

16. The brilliant toner according to claim 1, wherein the toner particles containing the brilliant pigment contain a release agent, and a melting temperature of the release agent is from 50° C. to 110° C.

17. The brilliant toner according to claim 1, wherein a content of the release agent is from 1% by weight to 20% by weight with respect to all of the toner particles.

18. The brilliant toner according to claim 1, wherein a number average particle diameter of the brilliant toner particles is from 1 μm to 30 μm.

19. An electrostatic charge image developer comprising:

the brilliant toner according to claim 1.

20. A toner cartridge that contains the brilliant toner according to claim 1 and is detachable from an image forming apparatus.

* * * * *